US008181280B2

(12) United States Patent
Caliste

(10) Patent No.: US 8,181,280 B2
(45) Date of Patent: May 22, 2012

(54) DISABLED INDIVIDUAL UNDERGARMENT AND OUTER GARMENT

(76) Inventor: Joanell Jenkins Caliste, Stockbridge, GA (US)

( * ) Notice: Subject to any disclaimer, the term of this patent is extended or adjusted under 35 U.S.C. 154(b) by 218 days.

(21) Appl. No.: 12/624,485

(22) Filed: Nov. 24, 2009

(65) Prior Publication Data

US 2011/0119814 A1 May 26, 2011

(51) Int. Cl.
*A41B 9/00* (2006.01)

(52) U.S. Cl. ..... 2/400

(58) Field of Classification Search ..... 2/227, 228, 2/234, 235, 236, 237, 78.2, 400–403, 405
See application file for complete search history.

(56) References Cited

U.S. PATENT DOCUMENTS 3,451,063 A * 6/1969 Dwork ..... 2/402
3,604,604 A 9/1971 Ahn
3,763,866 A * 10/1973 Bienenfeld ..... 450/134
3,860,156 A 1/1975 Lawrence
3,937,512 A 2/1976 Baughman
4,145,763 A * 3/1979 Abrams et al. ..... 2/403
4,581,772 A * 4/1986 Smith ..... 2/111
4,597,110 A * 7/1986 Smith et al. ..... 2/408
4,610,680 A * 9/1986 LaFleur ..... 604/385.11
4,637,078 A * 1/1987 Southwell ..... 2/408
4,644,589 A * 2/1987 Pettis ..... 2/109
4,675,918 A * 6/1987 O'Brien ..... 2/402
4,835,795 A * 6/1989 Lonon ..... 2/408
4,914,756 A * 4/1990 Grassick ..... 2/227
4,966,316 A 10/1990 George et al.
5,546,608 A * 8/1996 Russano ..... 2/408
5,687,889 A 11/1997 Liden
6,014,777 A * 1/2000 Gupton ..... 2/400
6,108,823 A * 8/2000 Danes ..... 2/403
2004/0034902 A1* 2/2004 Yturria ..... 2/400
2008/0066213 A1* 3/2008 Ha ..... 2/83

* cited by examiner

*Primary Examiner* — Gary L Welch
*Assistant Examiner* — Anna Kinsaul
(74) *Attorney, Agent, or Firm* — Merchant & Gould

(57) ABSTRACT

The present invention is an enhanced undergarment that enables easier dressing and undressing by disabled individuals by allowing the user to don the garment from the buttock area. The garment is configured with a unique back panel at the buttock area that it is divided into two separate panels, a right panel and a left panel. The left and right panels of the undergarment are not seamed but remain open; this opening is from the top of the elastic band to the crotch. Seams are placed to attach the sides of the two separates panels to the front panel, joining the right and left sides. The undergarments are configured with standard leg openings. A seam is also at the crotch. Before the seam is placed at the crotch area, the bottoms of the back panels are designed to overlap. The overlap facilitates better closure and provides space for extra fasteners if needed. The left and right panels include male and female fasteners which allow the user to manually open and close the back panels.

11 Claims, 3 Drawing Sheets

DISABLED INDIVIDUAL UNDERGARMENT AND OUTER GARMENT

BACKGROUND OF THE INVENTION

I. Field of the Invention

The invention is directed generally to undergarments or outerwear configured to aid persons that are disabled and or physically challenged as a result of injury, illness or age to dress. Specifically, it is an undergarment or outerwear configured to assist a physically challenged individual in donning the undergarment or outerwear, when the individual has restricted or no use of the lower extremities.

II. Background Information

An individual for various reasons may have difficulties using their lower extremities in order to get undergarments or outer garments up the leg openings and over or under the buttock area into a comfortable proper position. The inability to accomplish this seemingly simple, but very necessary task may be the result of temporary or permanent, limited or total loss of flexibility to the lower extremities.

For many elderly individuals, as well as others suffering from certain diseases and injuries, including an increasingly young population of injured military personnel, except for the physical challenges associated with injuries to the back and certain losses of mobility associated with such injuries that are beyond the scope of this invention, there is a major need for assisting disabled individuals with dressing. People without these disabilities can function carefree when dressing or undressing or using the toilet. However, people with lower extremity disabilities may find these tasks challenging and/or time consuming. Devices to respond to this need are recognized as making a significant contribution to an individual's independence.

A wide variety of devices have been developed to assist physically challenged individuals in their daily lives. One class of such devices is variously described as "reachers." Reachers commonly comprise a shaft of varying length with some type of "jaws" at one end that are operated by a manual trigger device at the other, handle end. Such devices are used effectively to retrieve items from the floor, tables, or shelves, and have been modified to assist an individual in putting on socks and shoes. Dressing aids, including modified reachers noted above, have been developed for a variety of specific uses: long-handled shoe horns to help those that cannot easily bend from the waist; plastic sleeves to assist in putting on socks and stockings, frequently such devices includes a "pull-stick" to move the sock/stocking into position once it is positioned over the foot and ankle. Dressing sticks comprising a stiff shaft and soft "hook" at the opposite end of the grip area are used by some to help pull-up pants legs.

Certain dressing aids and predecessor technology are the object of several United States patents. Among early prior art is a "grab-stick," a shaft with pull action jaws to pick-up litter and a forerunner to "reachers" issued as U.S. Pat. No. 3,937,512 to Harold Baughman on Feb. 10, 1976. Also see U.S. Pat. No. 5,687,889 for a multipurpose dressing rod and reacher issued Nov. 18, 1997 to Douglas T. Liden.

Several patents involve technology specifically focused on putting socks or stockings on. See for example U.S. Pat. No. 3,604,604 issued Sep. 14, 1971 to Albert D. Ahn and U.S. Pat. No. 3,860,156 issued Jan. 14, 1975 to Ralph Lawrence. In some instances, multiple uses are suggested as in the "shoe horn and cane" apparatus of U.S. Pat. No. 4,966,316 issued to Curtis L. George and Sandra L. George on Oct. 30, 1990. While these devices are excellent examples of devices that can assist people that are disabled and or physically challenged, there is a need for a garment having a configuration that independently aids individuals in dressing and undressing.

When a disabled person with lower extremity problems is dressing or undressing in bed with a standard undergarment or outer garment it can be difficult. They must first lift their legs while pulling the garments up the legs, then turn numerous times from side to side or lift the buttock area in a bridge position to don or remove the garment from the buttock area. This can be very difficult, tiresome, time consuming and in some people even painful.

Another problem with a standard undergarment or outer garment, such as slacks or shorts, occurs when a disabled individual is using the toilet, especially in a public restrooms. In this situation, to stand and hold on to something while they remove or replace garments to the buttock area, this can be unsafe. The individual is relying on a structure to be sturdy. In this scenario, one hand is holding the structure while the other hand is adjusting the garment to the buttocks. If standing is not an option, the disabled person must transfer directly to the toilet from their wheelchair. When sitting on the toilet seat to remove and replace the garment to the buttocks the person has to sway their body from side to side while pulling up or lowering the garment. There is a need for a garment that provides a disabled person with better control of the donning, removal and replacement of garments. There is a need for a garment structurally configured to facilitate safe control of an individual's body movements when donning or removing garments from the buttock area. There is a need for a garment that allows a disabled person to have less contact or touching of other surrounding areas while using the toilet.

SUMMARY OF THE INVENTION

Consistent with embodiments of the present invention, an improved garment is disclosed. An improved garment comprised of a front panel and a rear panel connected and configured to have a waist opening along a seam of the front and rear panels and two leg openings so that the garment covers at least the lower torso of the wearer. The rear panel is comprised of a first panel portion and a second panel portion, the first and second panel portions are positioned to overlap each other along an edge of each of the first and second panels. The edges of the first and second panels are located proximate a central axis of the rear panel. A first portion of the overlapping edges of the first and second panel portions are stitched together near the lower portion of the first and second panel portions in proximity to a crotch area of the garment. A second portion of the overlapping edges of the first and second panel portions are removably fastened by at least one connector system positioned along the second portion of the overlapping edges of the first and second panels. The edges of the first and second panels extend from the top of the rear panel down to a crotch area of the garment. The first and second panel portions are connected in a manner whereby the second panel portion overlaps the first panel portion. The second panel portion has a second fastener portion of the connector system positioned along an interior surface edge of the second panel portion. The first panel portion has a first fastener portion of the connector system positioned along an exterior surface edge of the first panel portion.

It is to be understood that both the foregoing summary of the invention and the following detailed description are exemplary and explanatory only, and should not be considered restrictive of the scope of the invention, as described and claimed. Further, features and/or variations may be provided in addition to those set forth herein

BRIEF DESCRIPTION OF THE DRAWINGS

The accompanying drawings, which are incorporated in and constitute a part of this disclosure, illustrate various embodiments and aspects of the present invention. In the drawings.

GENERAL DESCRIPTION

Figure 1A:
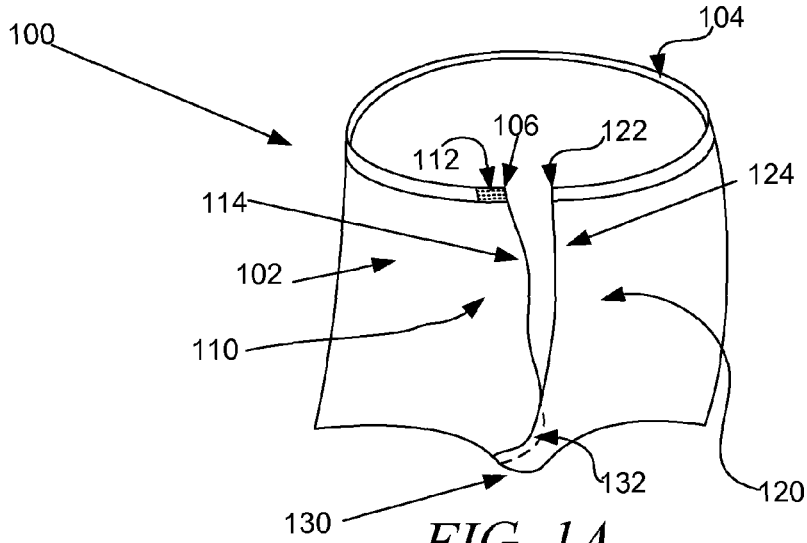
FIG. 1*a* is a perspective of one embodiment of the present invention.

Consistent with embodiments, the present invention is a garment configured with a rear panel having a fastening system along a seam separating the rear panel into two rear panel portions. When the fastening system is not engaged, and the two rear panel portions are not connected, the rear panel generates two flaps, thereby opening the rear panel which facilitates removal of a garment with minimal lifting of the buttock. By lifting the buttock, the user may slide the garment including the rear panel fastening system over or under the buttock area one side at a time. Garments configured with the rear panel fastening system facilitate a safer method for disabled individuals to don or remove such garments.

The present invention may be garments of the type that are undergarments or outer garments including the rear panel fastening system. Such garments are to be configured for covering at least the lower torso of a disabled person. The garment includes all the components of a standard under garment, such as panties, briefs or boxers. The outer garment includes all the components of standard pants or slacks.

People who are struck with debilitating conditions of the lower extremities have to learn simple everyday tasks over again. Tasks such as dressing themselves, using the toilet, sitting up, transferring from one place to another, etc. Dealing with all new ways to function throughout the day can be overwhelming. The present invention facilitates an easier way for disabled individuals to don and remove undergarments and outer garments from the lower torso and legs.

The garment comprises at least a front lower torso panel and a rear lower torso panel that may be configured as one or more pieces that are connected to form a lower torso garment. The lower torso garment has a top opening for a person's trunk, a first bottom opening for a person's left leg and a second bottom opening for a person's right leg. The rear lower torso panel of the garment has a rear panel fastening system that facilitates the opening and closing of a rear panel opening along the rear lower torso panel seam generated by the permanent and temporary connection of a first panel portion and a second panel portion of the rear lower torso panel. Along the rear lower torso panel seam, the first panel portion and the second panel portion overlap and are permanently connected along the lower portion of the first and second panel portions by stitching the lower section of the first and second panel portions together near the crotch of the garment. The remaining section of the first and second panel portions that are not connected by stitching. They are connected by a connector system that connects the first and second panel portions at least at the top of the edge of the panel portions, but preferably along the overlapping edges beginning in proximity to the point where the stitching connection of the first and second panel portions ends.

The connector system which is comprised of first and second connector portions has a first connector portion positioned along an edge of an interior surface of the first panel portion of the rear panel. The second panel portion of the rear panel has a second connector portion of the connector system positioned along an edge of an exterior surface of the second panel portion of the rear panel. In one embodiment, the connection system is a VELCRO® (i.e., hook and loop) connection system. In another embodiment, the connection system is a button, positioned along an edge of an exterior surface of the second panel portion of the rear panel, and button hole, extending through and along an edge of the first panel portion of the rear panel, wherein the button hole is configured to receive a button. In other embodiments, the connection system may be any connector system having male and female portions which facilitate connection of two overlapping fabric panels.

In one embodiment, the garment is an undergarment. In another embodiment, the garment is an over garment, wherein the front and rear panels extend and cover the lower torso and the legs of the user. In either embodiment, it is contemplated that the garment may be configured to integrate an elastic band with a waistband along the top of the lower torso opening. Both the over garment and the undergarment are equipped with two back panels that are separated from the top of the waistband to the crotch. Fastening devices are placed at the edges of the first and second panel portions of the rear panel which when engaged, closes up the garment. When the fastening devices are disengaged, flaps of the first and second rear panel portions are opened and enable easier donning or removal of an embodiment of the garment. The opening created by the flaps of the first and second rear panel portions allows a garment user to lie or sit and remove or replace a garment by lifting the buttock a little and using a sliding motion of the flaps under or over the buttock area.

It is contemplated that the present invention may be adapted to a variety of undergarments, including panties for women and girls and briefs and or boxers for men and boys. It is contemplated that the present invention has application on a myriad of different types of panties and briefs. For example, panties for women and girls include by are not limited to regular cut panties, low cut panties, bikinis, etc. It is also contemplated that the garments may be comprised of a plurality of fabrics, including disposable materials. It is also contemplated that the present invention has application to a myriad of different types of outerwear, including but not limited to pants of all different fabric types, pajamas, shorts, etc.

It is an object of the present invention to allow the user to open the rear panel of the garment by unfastening the connection system positioned along the edges of the first and second panel portions of the rear panel, causing the rear panel to open along a seam along the center of the rear panel thereby creating panel flaps. The user may then place their feet through the leg openings and pull the garment up over their legs to a point just below the buttock area. When the garment is below the buttock the user turns to one side and slides the first panel portion's flap over the buttock and repeats the action on the other side. The connection system fasteners may be fastened to the closed position thereby securing the garment upon the lower torso of a person. To undress a disabled person performs this procedure in reverse. It is an object of the present invention to facilitate ease of donning a garment whereby the garment is slid onto a person's legs and over their buttock area for easier application and removal.

It is a further object of the present invention to allow the user of the garment to better control its removal and replacement when the user donning the garment is physically challenged, or has restricted or no use of their lower extremities. In the context of a disabled individual who desires to use public restroom facilities without the assistance of others, the present invention allows the user to rest on a toilet first and then unfasten the back panels of the garment. While the individual donning the garment holds one side of the top corner of one of the first and second panel portions, they may tilt their body in the same direction of the panel being held. This action will lift the buttock of the individual a little above the toilet seat. Next the user may slide a flap of the first and second panel portions under the buttock of the individual up to their respective thigh. This action may be repeated using the opposing panel portion of the first and second panel portions for which the above steps have not been completed. When the garment is down under the buttock of the individual up to the thigh area, the individual user has access to use the toilet. To return the garment to the buttocks area, the individual user tilts their body until their buttock is lifted on one side. Next the garment is slid over that side of the buttock that is lifted. Next, the individual user tilts their body until their other buttock is lifted on the opposing side. The garment should then be in position on the lower torso of the individual user. The user may then secure the garment to the lower torso by way of closing the connectors of the connector system.

Another object of the present invention is to provide a user of the garment with a safer way to control their respective body movements when donning or removing garments of the type described herein from the lower torso area. The control provided by the present invention will provide a safer method of donning and removal of over garments and under garments. While in a sitting position an individual user may open the back area of the garment described herein and release the flap portion of the first and second panel portions of the rear panel and slide the garment over or under the buttock with minimal or little lifting of each buttock. The invention includes both under garments and outer garments that are designed to aid in complete dressing of the lower torso. Both articles will house the back open extended panels with fasteners. The garments are independent and can be worn separate if desired.

DETAILED DESCRIPTION

The following detailed description refers to the accompanying drawings. Wherever possible, the same reference numbers are used in the drawings and the following description to refer to the same or similar parts. While several embodiments and features of the invention are described herein, modifications, adaptations and other implementations are possible, without departing from the spirit and scope of the invention. Rather these embodiments are provided so that this disclosure will be complete and will fully convey the invention to those skilled in the art. For example, substitutions, additions or modifications may be made to the components illustrated in the drawings, and the methods described herein may be modified by substituting, reordering or adding steps to the disclosed methods. Accordingly, the following detailed description does not limit the invention. Instead, the proper scope of the invention is defined by the appended claims.

Figure 1B:
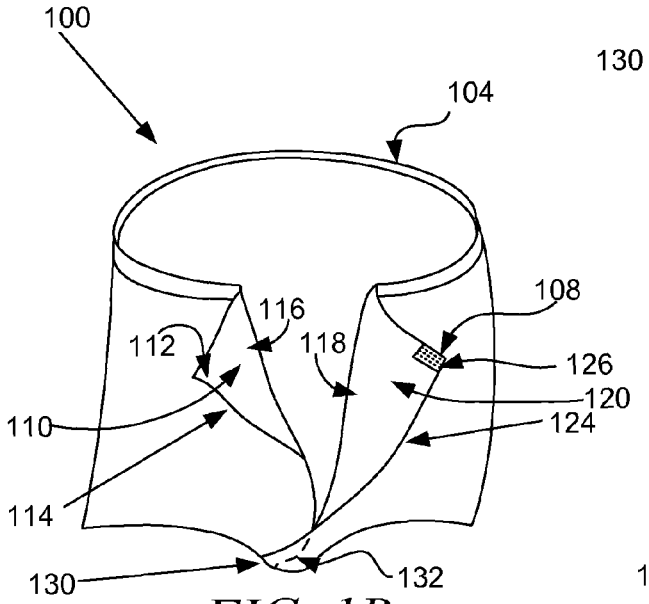
FIG. 1*b* is a perspective of one embodiment of the present invention illustrating an open panel view.
Figure 1C:
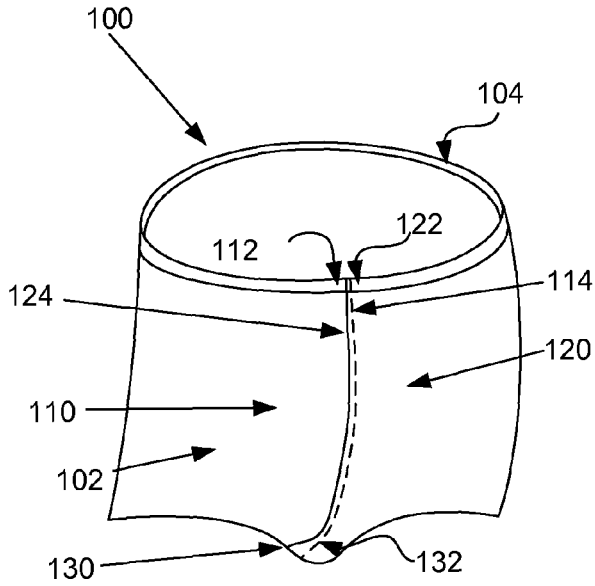
FIG. 1*c* is a perspective of one embodiment of the present invention illustrating a closed panel view.

In one embodiment, the present invention comprises an undergarment configured as a standard under garment including a lower torso rear panel as illustrated in FIGS. 1*a*-1*c*, 2*a*-2*c*. As shown in FIGS. 1*a*-1*c*, the rear view of an undergarment 100 illustrates a rear panel 102 of an undergarment improved to include a panel accessibility system. The rear panel 102 includes a portion of a waistband 104, which in one embodiment is integrated with elastic. In an alternative embodiment, the waistband 104 may be comprised of the same material as the rear panel. Sizing of waistband 104, which includes waistband first end 112 and a waistband second end 122, as illustrated in FIG. 1*a*, may be performed through positioning of a waistband fastening system. In FIG. 1*a*, the waistband fastening system are first and second portions of a VELCRO® fastening system. A first portion 106 of the VELCRO® fastening system is illustrated in FIG. 1*a*. A second portion 108 of the VELCRO® fastening system is illustrated in FIG. 1*b*. As is understood by a person of ordinary skill in the art, the circumference of waistband 104 may be increased or decreased based on the positioning of waistband first end 112 in relation to waistband second end 122 through use of a fastening system such as the VELCRO® fastening system. It is also contemplated that the fastening system may be buttons, snaps, hook and eye, zippers, ties or any other available fastener capable of connecting the waistband first end 112 in relation to waistband second end 122.

Rear lower torso panel 102 is comprised of a first rear panel portion 110 and a second rear panel portion 120. First rear panel portion 110 has a first rear panel edge 114. Second rear panel portion 120 has a second rear panel edge 124. During construction of garment 100, the first rear panel portion 110 and the second rear panel portion 120 are stitched together in a manner whereby one of the first and second rear panel portions 110, 120 overlaps the other as illustrated in FIG. 1*c*. In the embodiment illustrated in FIGS. 1*a*-1*c*, the first rear panel portion 110 and the second rear panel portion 120 are stitched together towards the lower portion of the rear lower torso panel 102 in the crotch region 132, in a manner that the second rear panel portion 120 overlaps the first rear panel portion 110. As illustrated in FIG. 1*c*, when the first rear panel portion 110 and the second rear panel portion 120 are fastened together, the second rear panel portion 120 overlaps the first rear panel portion 110 all the way up the entire rear lower torso panel 102 as illustrated in FIG. 1*c* by the covering of a piece of the first rear panel portion 110 and the first back panel edge 114 by the second rear panel portion 120. In one embodiment, the first rear panel portion 110 and the second rear panel portion 120 have elastic along the waistband 104 which extends around the edge of rear panel 102 to the front of the garment.

Figure 2B:
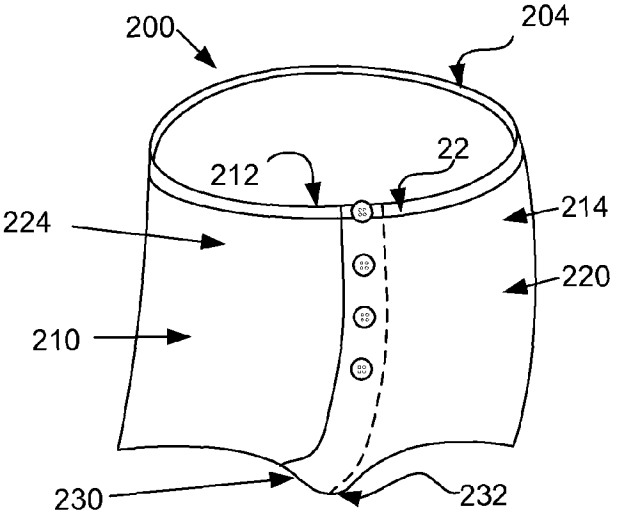
FIG. 2*b* is a perspective of one embodiment of the present invention illustrating a closed rear panel and the reinforcement created by wrapping a strip of fabric around the edges of the first and second rear panel portions.

FIG. 1*a* illustrates the first rear panel portion 110 and the second rear panel portion 120 slightly opened and released from connection. FIG. 1*b* illustrates the first rear panel portion 110 and the second rear panel portion 120 further opened and released from connection wherein a section of the first and second rear panel portions 110 and 120 are folded back to expose the interior surface of the first and second rear panel portions 110 and 120 and thereby create first and second garment flaps 116 and 118. When waistband first and second ends 112, 122 are connected as illustrated in FIG. 1*c*, the first and second rear panel portions 110 and 120 overlap in order to provide secure closure and a uniform rear lower torso panel 102 that covers the buttock area when the garment is worn by a person. The connectors may be positioned as a single connector at the top of first and second rear panel portions 110 and 120 as illustrated by VELCRO® connectors 106 and 108 positioned at the waistband first and second ends 112 and 122. Alternatively, the connectors may be positioned at multiple locations along the edge of first and second rear panel portions 110 and 120. In the embodiment illustrated, the fasteners, which act as a connection system are VELCRO® and only positioned to securely attach the waistband first and second ends 112 and 122. However, it is contemplated that the VELCRO® system may comprise multiple VELCRO® connectors positioned along the edges of first and second rear panel portions 110 and 120. In is also contemplated that the connectors may be buttons as illustrated in FIGS. 2*a* and 2*b*, or the connector may be snaps, hook and eye, zippers, clasps, ties or any other available option capable of connecting the edges of the first and second rear panel portions 110 and 120.

FIGS. 1*a*-1*c* and 2*a*-2*c*, and 3, illustrate that the rear lower torso panel 102 opens down its center. It is contemplated that the opening of the rear lower torso panel 102 that creates first and second rear panel portions 110, 120, may be more to the right or left side of rear panel 102.

Figure 2C:
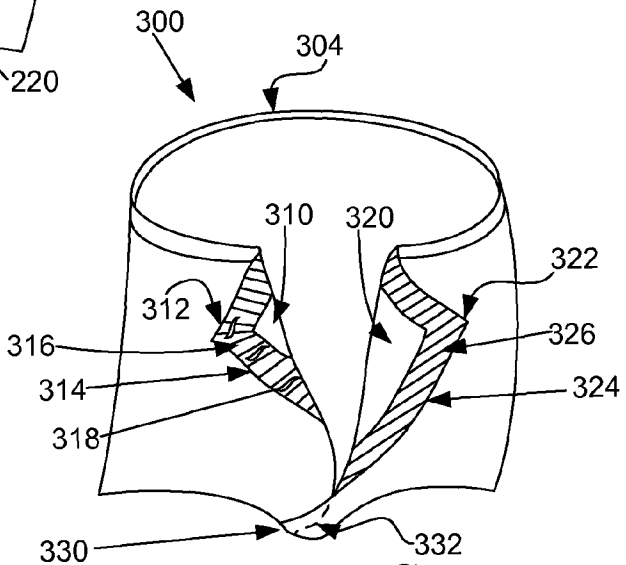
FIG. 2C is a perspective of one embodiment of the present invention illustrating an open panel and the reinforcement created by placing facings to the edges of the first and second rear panel portions.
Figure 2A:
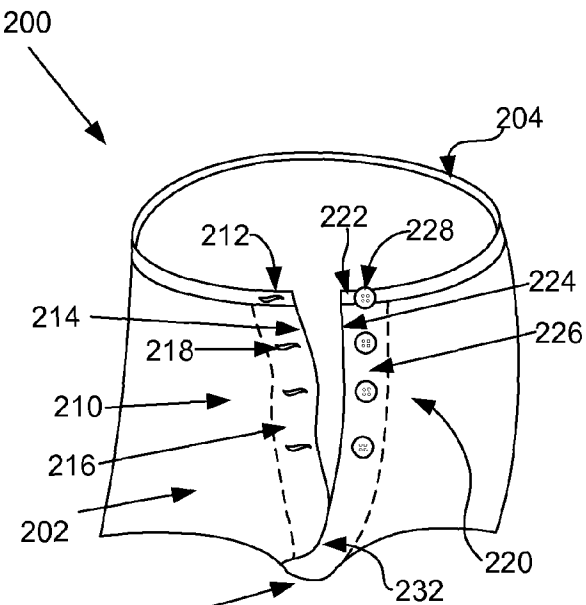
FIG. 2*a* is a perspective of one embodiment of the present invention illustrating an open panel and the reinforcement created by doubling the fabric on each panel portion.

FIG. 2*a* illustrates one embodiment of a manner in which the rear panels of garment 200 may be reinforced by covering sections of the first and second rear panel portions 210 and 220 with additional fabric along the seam created at the area of overlap of the first and second rear panel portions 210 and 220 of rear lower torso panel 202. FIGS. 2*a* and 2*c* illustrate the use of additional overlapping strips of fabric 216 and 316 that extend from the garment waistband 204 and 304 to the bottom of garment 200 and 300 where the first rear panel portions 210 and 310 and the second rear panel portions 220 and 320 end.

FIG. 2*c* illustrates doubling the fabric on the inside of the first and second rear panel portions 310 and 320. However, it is contemplated that the fabric may be reinforced over each entire lower torso panel 202 or a defined area of the rear lower torso panel portion. In the embodiment illustrated in FIG. 2*c*, the doubling of fabric covers only a portion of the edges of the first and second rear panel portions 310 and 320. However, it is contemplated that the entire first and second back panel portions covering the lower torso may be reinforced. It is also contemplated that a facing may be used on each panel opening.

Figure 3:
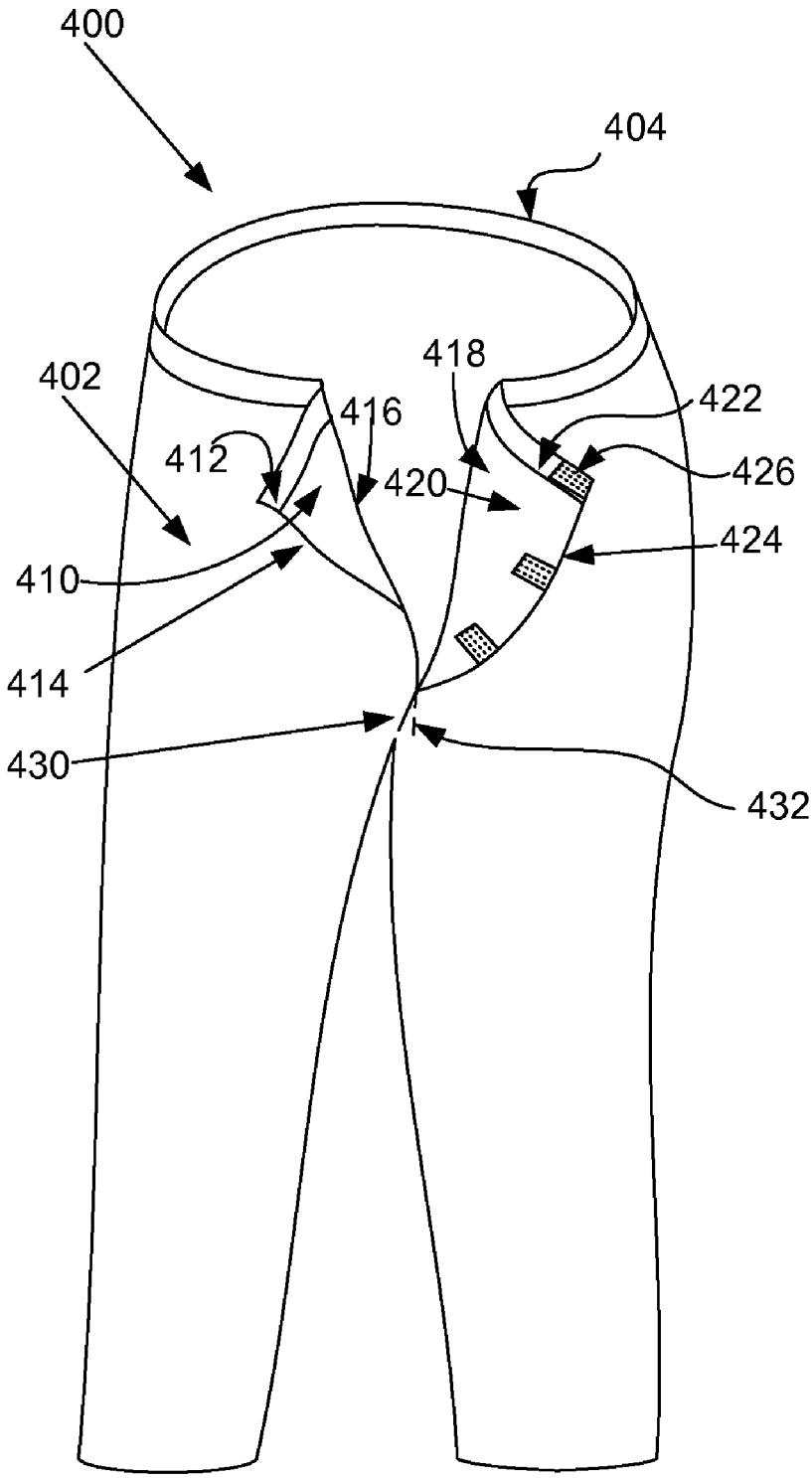
FIG. 3 is a perspective view of an embodiment of the present invention illustrating extending the leg covering portions of the front and rear panels to create outerwear.

FIG. 3 illustrates the present invention implemented on outer garment. The outer garment 400 may be standard shorts, slacks or pants configured with a back seam along the buttocks opening at the top from waistband 404 down to a crotch area 432. Rear lower torso panel 402 is comprised of a first rear panel portion 410 and a second rear panel portion 420. First rear panel portion 410 has a first rear panel edge 414. Second rear panel portion 420 has a second rear panel edge 424. During construction of garment 400, the first rear panel portion 410 and the second rear panel portion 420 are stitched together in a manner whereby one of the first and second rear panel portions 410, 420 overlaps the other. In the embodiment illustrated, the first rear panel portion 410 and the second rear panel portion 420 are stitched together towards the lower portion of the rear lower torso panel 402 in the crotch region 432, in a manner that the second rear panel portion 420 overlaps the first rear panel portion 410. In one embodiment, the first rear panel portion 410 and the second rear panel portion 420 have elastic along the waistband 404 which extends around the edge of rear panel 402 to the front of the garment.

As illustrated, when the first rear panel portion 410 and the second rear panel portion 420 are opened and the fastening system has been released a section of the first and second rear panel portions 410 and 420 are folded back to expose the interior surface of the first and second rear panel portions 410 and 420 and thereby create first and second garment flaps 416 and 418.

When waistband first and second ends 412 and 422 are connected, the first and second rear panel portions 410 and 420 overlap in order to provide secure closure and a uniform rear lower torso panel 402 that covers the buttock area when the garment is worn by a person. The connectors may be positioned as a single connector at the top of first and second rear panel portions 410 and 420 as VELCRO® connectors 406, 408 and 416 positioned along the edge of first and second rear panel portions 410 and 420. Alternatively, the connectors may be positioned at a single location along the edge of first and second back panel portions 410 and 420.

In the embodiment illustrated, the fasteners, which act as a connection system are VELCRO® and only positioned to securely attach the edges of the first and second rear panel portions 410 and 420. However, it is contemplated that the connectors may be buttons as illustrated in FIGS. 2*a* and 2*b*, or the connector may be snaps, hook and eye, zippers, clasps, ties or any other available option capable of connecting the edges of the first and second rear panel portions 410 and 420.

It is also contemplated that the outerwear garments and under garments may be worn together and fastened together, thereby creating a joint garment system. These fasteners will attach to the two garments together; for example, attaching the under garment 100 illustrated in FIGS. 1*a*-1*c* and outer garment 400 illustrated in FIG. 3 to make them a joint garment system functioning as one working unit. The fasteners, not shown, are placed in various positions around the waistbands 104 and 404 to secure the joining of the two garments. The fasteners will be placed on the outside of the undergarment waistband 104 and on the inside of the outerwear garment waistband 404. The undergarment 100 and outerwear garment 400 may be worn together attached as one unit or together unattached. The undergarment 100 and outerwear garment 400 may also be worn separately.

Reference may be made throughout this specification to "one embodiment," "an embodiment," "embodiments," "an aspect," or "aspects" meaning that a particular described feature, structure, or characteristic may be included in at least one embodiment of the present invention. Thus, usage of such phrases may refer to more than just one embodiment or aspect. In addition, the described features, structures, or characteristics may be combined in any suitable manner in one or more embodiments or aspects. Furthermore, reference to a single item may mean a single item or a plurality of items, just as reference to a plurality of items may mean a single item. Moreover, use of the term "and" when incorporated into a list is intended to imply that all the elements of the list, a single item of the list, or any combination of items in the list has been contemplated.

One skilled in the relevant art may recognize, however, that the invention may be practiced without one or more of the specific details, or with other methods, resources, materials, etc. In other instances, well known structures, resources, or operations have not been shown or described in detail merely to avoid obscuring aspects of the invention.

While example embodiments and applications of the present invention have been illustrated and described, it is to be understood that the invention is not limited to the precise configuration and resources described above. Various modifications, changes, and variations apparent to those skilled in the art may be made in the arrangement, operation, and details of the methods and systems of the present invention disclosed herein without departing from the scope of the claimed invention.

The above specification, examples and data provide a description of the manufacture and use of the invention. Since many embodiments of the invention can be made without departing from the spirit and scope of the invention, the invention resides in the claims hereinafter appended.

What is claimed is:

1. An article of underwear configured for covering at least the lower torso of a disabled person comprising:

a cloth underwear comprising a front lower torso panel and a rear lower torso panel, the cloth underwear having a top opening and a waistband for a person's trunk and a first bottom opening for a person's left leg and a second bottom opening for a person's right leg;

the front lower torso panel at least being connected along a first seam to the rear lower torso panel in a crotch area of the underwear;

wherein the rear lower torso panel is comprised of a first portion and a second portion, wherein each of the first and second portions comprise an upper section and a crotch section, the crotch section located in the lower part of the underwear and the upper section located immediately above the crotch section, the upper and crotch section of the first portion corresponding to a respective upper body and crotch section of the second portion;

the first and second portions are connected along a rear panel seam, proximate the central axis of the rear lower torso panel;

wherein when the first and second portions are connected, the first portion overlaps the second portion;

the first and second upper sections of the first and second portions being removably connected by a connector system, the first and second crotch sections of the first and second portions are stitched together immediately below the first and second upper sections in the crotch area of the underwear;

wherein the first upper section has a first fastener of the connector system positioned along an edge of an interior surface of the first upper section and the second upper section has a second complementary fastener of the connector system positioned along an edge of an exterior surface of the second upper section, wherein at least one of the first portion or the second portion comprises reinforcement located near the rear panel seam, wherein the reinforcement proximate the rear panel seam comprises an additional fabric layer that overlaps at least an edge of the first portion or an edge of the second portion, and wherein the connector system further comprises at the waistband a waistband fastening system, and wherein the waistband fastening system comprises a fastener and a complementary fastener that extends horizontally such that adjustment of the circumference of the waistband may be increased or decreased by positioning of the first upper section edge to the second upper section edge of the underwear, and wherein said waistband has a plurality of fasteners around an outside of the waistband for securing the underwear to a complementary fastener on the inside of a waistband on a piece of outerwear.

2. An improved underwear garment comprised of a front panel and a rear panel connected and configured to have a waist opening and two leg openings for covering at least the lower torso of a wearer, the improvement comprising:

the front panel at least being connected along a seam to the rear panel in a crotch area of the garment;

the rear panel comprised of a first portion and a second portion, wherein each of the first and second portions comprise an upper body section and a crotch section, the crotch section located in the lower part of the garment and the upper body section located immediately above the crotch section, the upper body and crotch section of the first portion corresponding to a respective upper body and crotch section of the second portion;

wherein the first and second portions are positioned to overlap each other along an edge of each of the first and second portions, the edges of the first and second portions located proximate the central axis of the rear panel, wherein at least one of the edges of the first or the second portion comprises a reinforcement layer that comprises additional fabric strips, wherein the first and second crotch sections of the overlapping edges of the first and second portions are stitched together in the crotch area of the underwear garment;

wherein the first and second upper body sections of the overlapping edges of the first and second portions are removably attached by at least one connector system positioned along the first and second upper body sections of the overlapping edges of the first and second portions, wherein the edges of the first and second portions extend from a top edge of the rear panel down to said crotch area of the garment and the first and second upper body sections are removably attached from the top edge to the stitched overlapping edges of the first and second crotch sections in the crotch area, and wherein the connector system further comprises at the top of the rear panel an elastic waistband and a waistband fastening system, and wherein the waistband fastening system comprises a fastener that extends in a horizontal direction such that adjustment of the circumference of the waistband may be increased or decreased by positioning of the first portion edge to the second portion edge of the garment, and wherein said waistband has a plurality of fasteners around an outside of the waistband for securing the underwear garment to a complementary fastener on the inside of a waistband on an outerwear garment.

3. The improved garment of claim 2, wherein when the first and second portions are connected, the first portion overlaps the second portion, and the first upper body section has a first fastener of the connector system positioned along an interior surface edge of the first upper body section and the second upper body section has a second fastener of the connector system positioned along an exterior surface edge of the second upper body section.

4. The improved garment of claim 3, wherein the first fastener of the connector system is a female connector portion.

5. The improved garment of claim 3, wherein the second fastener portion of the connector system is a male connector portion.

6. The improved garment of claim 3, wherein the connector system is a hook and loop connection system.

7. The improved garment of claim 3, wherein the connector system is a snap fastener connection system.

8. The improved garment of claim 2, wherein the connector system is a fastening hole positioned along an interior surface edge of the first upper body section and a complementary fastener has a male connector positioned along an exterior surface edge of the second upper body section.

9. The article of claim 1, wherein the reinforcement is an additional fabric layer comprising at least one fabric strip that overlaps a portion of the first portion and a portion of the second portion.

10. The article of claim 1, wherein the reinforcement extends from the waistband to the crotch.

11. The article of claim 1, wherein the reinforcement comprises both the first portion and the second portion each having an additional fabric layer extending from the waistband to the crotch.

* * * * *